US010368717B2

(12) United States Patent
Lippera et al.

(10) Patent No.: US 10,368,717 B2
(45) Date of Patent: Aug. 6, 2019

(54) DISHWASHER HAVING A LIGHT SIGNAL PROJECTOR

(71) Applicant: INDESIT COMPANY S.P.A., Fabriano (IT)

(72) Inventors: Mario Lippera, Cerreto D'Esi (IT); Roberto Giorcelli, Turin (IT); Giacomo Marvardi, Gubbio (IT)

(73) Assignee: Whirlpool Corporation, Benton Harbor, MI (US)

( * ) Notice: Subject to any disclaimer, the term of this patent is extended or adjusted under 35 U.S.C. 154(b) by 236 days.

(21) Appl. No.: 15/110,415

(22) PCT Filed: Dec. 15, 2014

(86) PCT No.: PCT/IB2014/066922
§ 371 (c)(1),
(2) Date: Jul. 8, 2016

(87) PCT Pub. No.: WO2015/101861
PCT Pub. Date: Jul. 9, 2015

(65) Prior Publication Data

US 2017/0164812 A1 Jun. 15, 2017

(30) Foreign Application Priority Data

Dec. 30, 2013 (IT) ..... PR2013A0114

(51) Int. Cl.
*A47L 15/42* (2006.01)
*F21V 23/04* (2006.01)
(Continued)

(52) U.S. Cl.
CPC ..... *A47L 15/4293* (2013.01); *F21V 5/04* (2013.01); *F21V 23/0407* (2013.01);
(Continued)

(58) Field of Classification Search
CPC ..... A47L 15/4293; A47L 15/00–508
See application file for complete search history.

(56) References Cited

U.S. PATENT DOCUMENTS 3,064,662 A 11/1962 Given et al.
3,862,786 A * 1/1975 Brezosky ..... A47L 15/4217 312/228

(Continued)

FOREIGN PATENT DOCUMENTS

EP 2363055 A1 9/2011

OTHER PUBLICATIONS

European Search Report for Counterpart PR20130114, dated Aug. 8, 2014.

(Continued)

*Primary Examiner* — Spencer E Bell
(74) *Attorney, Agent, or Firm* — McGarry Bair PC

(57) ABSTRACT

A dishwasher comprising a projection means having a concentration lens for concentrating a light beam coming from the light source, said concentration lens being external to the door and solidly constrained to a frame that encloses said access opening.
The light beam is projected by the lens towards the exterior of the dishwasher. Downstream of the lens, the light beam extends in a substantially horizontal direction. Downstream of the lens, the light beam intersects an imaginary vertical upwards projection of an upper edge (30) of the door (3) considered in the closed position.

13 Claims, 4 Drawing Sheets

(51) Int. Cl.

| | |
|---|---|
| ***F21V 5/04*** | (2006.01) |
| ***F21V 33/00*** | (2006.01) |
| ***F21W 111/00*** | (2006.01) |
| ***F21Y 113/13*** | (2016.01) |
| ***F21Y 115/10*** | (2016.01) |

(52) U.S. Cl.
CPC ..... *F21V 33/0044* (2013.01); *F21W 2111/00* (2013.01); *F21Y 2113/13* (2016.08); *F21Y 2115/10* (2016.08)

(56) References Cited

U.S. PATENT DOCUMENTS

| | | | | |
|---|---|---|---|---|
| 8,763,965 | B1 * | 7/2014 | Peay | A47L 15/427 248/205.1 |
| 2008/0121832 | A1 * | 5/2008 | Rosenbauer | A47L 15/46 251/129.15 |
| 2008/0178916 | A1 | 7/2008 | Kedjierski | |
| 2012/0320345 | A1 * | 12/2012 | Kleinert | A47L 15/4293 353/98 |

OTHER PUBLICATIONS

International Search Report and Written Opinion of the International Searching Authority for Counterpart PCT/IB2014/066922, dated Mar. 20, 2015.

* cited by examiner

DISHWASHER HAVING A LIGHT SIGNAL PROJECTOR

CROSS REFERENCE TO RELATED APPLICATIONS

This application claims priority to International Application No. PCT/IB2014/066922, filed Dec. 15, 2014, which claims priority to Italian Application No. PR2013A000114, filed Dec. 30, 2013, the entirety of which are incorporated herein by reference.

TECHNICAL FIELD

The present invention is a dishwasher comprising light signalling devices, particularly related to the achievement of the end-of-cycle state.

BACKGROUND OF THE INVENTION

Fully integrated built-in dishwashers are currently available. In such dishwashers, the door can comprises a panelling matching the decor of the surrounding cabinetry. The user interface is afforded in an edge of the door, which is completely concealed beneath an overlying work top (when the door is closed). In these types of machines, the end of the wash cycle can be signalled by an acoustic signal. However, this acoustic signal is usually not repeated indefinitely, in order to avoid annoyance. If a user is not present when the acoustic signal is being emitted, the user would have no indication of the fact that the machine has ended the wash cycle, given that the interface remains hidden if the door is closed.

There are also known design solutions for overcoming this inconvenience. In these cases, there is a light signal that is not directly visible from the exterior of the machine, but the solutions are equipped with a light guide that enables the light signal to be transferred so as to make it available to a user, informing him/her that the end of the wash has been reached.

In particular, in a first known design solution, an outlet for the light guide can be fashioned flush with a work top surface overlying the dishwasher. In this manner, the light beam is projected upwards. One drawback of this design solution concerns the fact that the light beam could be projected into the eyes of a user and thus be very bothersome.

In a second known design solution, the light guide could pass through the door. However, one problem with this solution lies in the fact that it creates discontinuity in the aesthetic appearance of the door, which may not be appreciated by a potential purchaser.

In this context, the technical task underlying the present invention is to offer a dishwasher that overcomes the above-mentioned drawbacks of the prior art.

SUMMARY OF THE INVENTION

In particular, an aim of the present invention is to make available a dishwasher that makes it possible to transmit a pre-encoded light signal to a user, while at the same time making it possible that attention is not drawn to the presence of a light signal emitter when this emitter is switched off. A further aim of the invention is to minimize the risk of the pre-encoded light signal being projected into a user's eye.

The defined technical task and the specified aims are substantially achieved by a dishwasher comprising the technical characteristics set forth in one or more of the appended claims.

BRIEF DESCRIPTION OF THE DRAWINGS

Further characteristics and advantages of the present invention will become more apparent from the approximate and thus not-limiting description of a preferred, but not exclusive, embodiment of a dishwasher, as illustrated in the accompanying drawings, of which.

DETAILED DESCRIPTION OF PREFERRED EMBODIMENTS OF THE INVENTION

Figure 2:
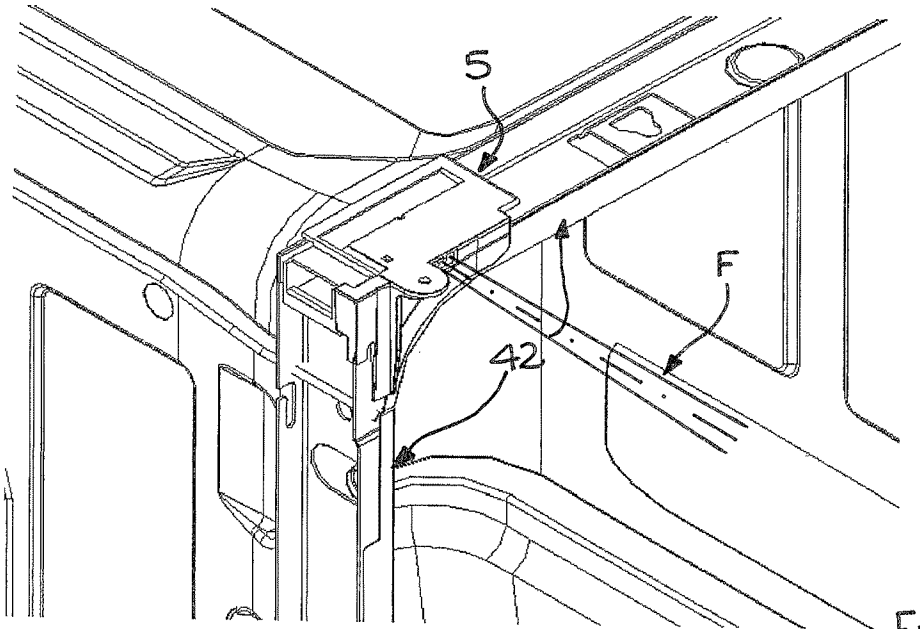
FIG. 2 is an enlarged view of FIG. 1.

In the accompanying figures, a dishwasher is indicated by the reference number 1. The dishwasher 1 comprises:

i) a washing compartment 2 for washing dishes; and ii) a door 3.

The door 3 is movable between an open position, in which it enables the insertion and removal of the dishes in/from the washing compartment 2, and a closed position, in which it is substantially vertical and closes an access opening 20 to the washing compartment 2. In the open position, the door 3 is substantially horizontal.

The dishwasher 1 comprises projection means 4 for projecting at least one pre-established light signal on an external surface. This pre-established light signal is associated for example with the wash cycle in progress or alternatively with the achievement of the end of the wash cycle or with an alarm or malfunctioning problem or with a specific operating condition (for example the lack of dishwasher salt or a rinse aid).

The presence of the pre-established light signal preferably indicates the end of the wash cycle. In particular, when the user sees the pre-established light signal, he/she knows that the door 3 can be opened without running the risk of interrupting a wash cycle in progress. At the end of the wash cycle, the user typically sees a spot of light, preferably a flashing light, on a surface located frontally to the door 3 of the dishwasher 1. In the case in which the light signal indicates the end of the wash cycle, the user has a clear indication of the fact that the dishwasher has completed the wash cycle and that the dishes can thus be removed from the compartment 2.

In an alternative, though not preferred, embodiment, the end-of-wash state could be signalled by the switching off of a given light signal projected by the means 4.

In a further design solution, the washing state in progress could be signalled by a first light signal projected by the means 4, whereas the end-of-wash state could be signalled by a second light signal (which would also be projected by the means 4). For example, the second light signal may be a flashing light and the first light signal may not be a flashing light. Alternatively, the first light signal could be of a first color and the second light signal of a second color.

Although several possible cases relating to the types of light signals that can be emitted by the projection means 4 have been illustrated above, it should be noted that in the preferred solution, the user has the option of regulating (by means of a specific selector on the user interface 99) the operation of the projection means 4 by selecting one of the following options:

- presence of a light signal that is not flashing during the wash and light signal flashing at the end of the wash (in this case, the flashing light becomes said pre-established light signal);
- absence of the light signal during the wash and light signal flashing at the end of the wash;
- absence of the light signal both during the wash and at the end of the wash (this being a situation in which the user actually excludes the use of the projection means 4, for example to avoid being disturbed).

The projection means 4 comprises a light source 40.

The projection means 4 also comprises a concentration lens 41 for concentrating a light beam coming from the light source 40. The concentration of the light beam by the lens 41 enables a more evident projection of the light beam. The concentration lens 41 is external to the door 3 and solidly constrained to a frame 42 that encloses said access opening 20. Advantageously, the frame 42 is, in turn, solidly constrained to a structural supporting frame of the dishwasher. In particular, both the light source 40 and the concentration lens 41 are supported by a crosspiece, which:

- is part of said supporting frame;
- extends above said access opening 20. The light source 40 and the concentration lens 41 are suitably aligned horizontally and located one in front of the other. The light source 40 emits the light beam horizontally in the direction of the lens 41 (in FIG. 2 the light beam is indicated schematically by the reference letter F). The light beam is projected by the lens 41 towards the exterior of the dishwasher. Downstream of the lens 41, the light beam extends in a substantially horizontal direction and intersects an imaginary vertical upwards projection of an upper edge 30 of the door 3 considered in the closed position. Conveniently, the lens 41 constitutes an optical element that extends in thickness along the direction of travel of the light beam. More specifically, the lens 41 is less than 4 millimeters in thickness, and preferably ranging between 2 and 3 millimeters.

The light beam is projected by the lens 41 perpendicularly to a plane surface that extends parallel to the door 3 in the closed position.

Figure 1:
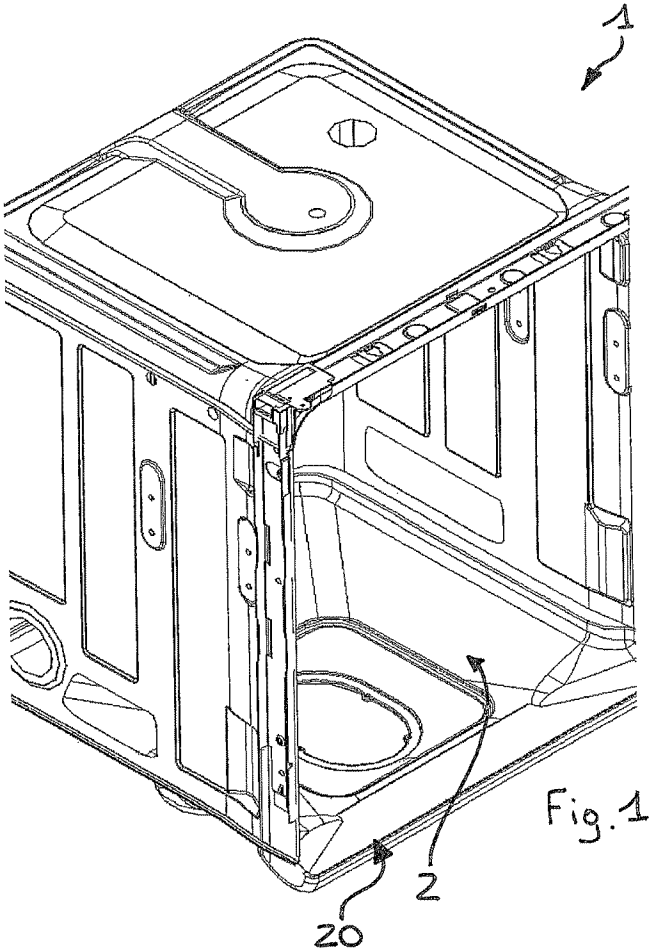
FIGS. 1, 5 and 6 are views of a first design solution according to the present design solution of the invention, with some parts being omitted so as to illustrate others more clearly.

The dishwasher 1 can consist of a fully-integrated built-in dishwasher (see FIGS. 1 and 2 in particular, in which the door is removed and in which the decorative panelling is missing). This type of dishwasher is also known in the art as a "fully integrated built-in dishwasher". With fully-integrated dishwashers, the user interface 99 is not visible when the door 3 is closed.

Figure 4:
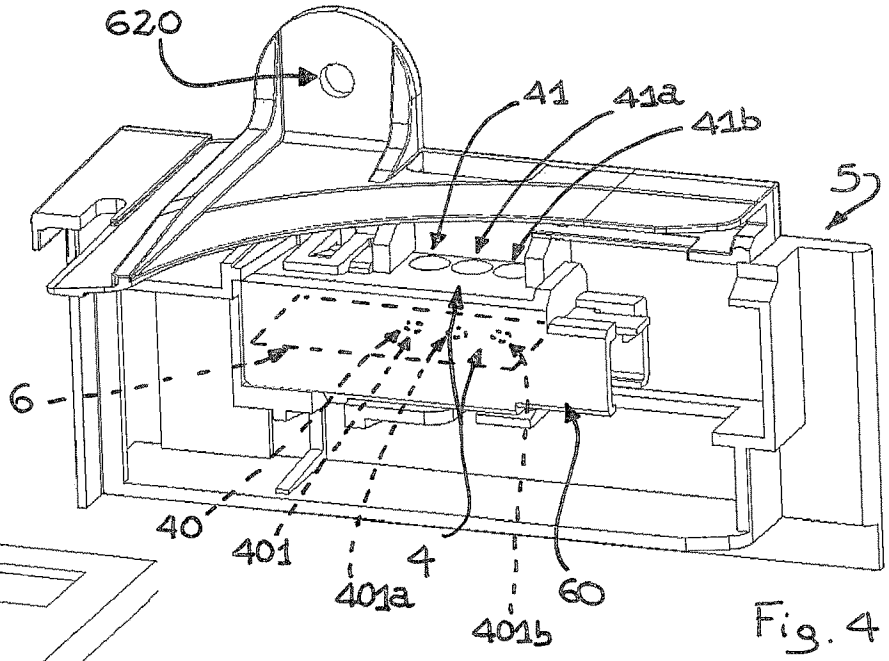
FIGS. 3 and 4 are detailed views of a component of the solution appearing in FIG. 1 or 2 or even of the solution appearing in FIG. 5 or 6.

Referring to FIG. 2, the dishwasher 1 comprises a bracket 5 for connecting the dishwasher to a work top located over said bracket. In general, this work top can be part of the dishwasher 1. In the "built-in" solution, this work top is typically external to the dishwasher. For example the bracket 5 is made of a polymeric material such as a polyamide. The presence of a bracket 5 for connecting a dishwasher and an upper work top is a known feature of built-in dishwashers. In the case illustrated by way of example in FIG. 4, the projection means 4 is advantageously housed in the bracket 5. In particular, the lens 41 and/or light source 40 are applied to the bracket 5.

The light source 40 comprises at least one LED 401 inserted in a protective casing 60. The light source 40 further comprises a printed circuit board 6 inserted in the casing 60. The LED 401 is conveniently integrated in the walls of said casing 60. Advantageously, the protective casing 60 is entirely made of a transparent material. For example, the casing 60 is made of polycarbonate. The protective casing 60 is preferably made as a single piece. Therefore, the lens 41 is made integrally with the remaining parts of the casing 60. The casing 60 is thus obtained through a single moulding procedure. The protective casing allows for protection of the light source from possible water leakage. As illustrated by way of example in FIG. 4, the light source 40 comprises a plurality of LEDs. In the preferred solution, these LEDs all emit light of the same color. This makes it possible to obtain a more intense light signal and thus a light signal that is more easily perceived by the user. However, the presence of one or more LEDs that emit lights of different colors could also be provided (for example associating a different pre-encoded message with each color).

The protective casing 60 can comprise a plurality of lenses 41, 41*a*, 41*b*, with each lens facing a corresponding LED 401, 401*a*, 401*b*.

In the preferred solution, the light beam is substantially continuous. The dishwasher 1 can further comprise means for activating/deactivating the intermittency of the light beam.

The protective casing 60 is secured to said bracket 5.

The casing 60 is removably connected to said bracket 5. The casing 60 is preferably removably connected to the bracket 5 by elastic deformation means.

The bracket 5 is preferably an angle bracket located at the junction of two edges of the perimeter of said access opening 20. The bracket 5 is for example interlocked with the remaining parts of the frame 42.

In the preferred solution, the bracket 5 comprises:

- a vertical wall 61 (arranged at the front) secured to both of said two edges of the perimeter of the access opening 20;
- a wall 62 extending horizontally and comprising a hole 620. The horizontal wall 62 also enables protection of the underlying projection means 4 from drips.

Figure 3:
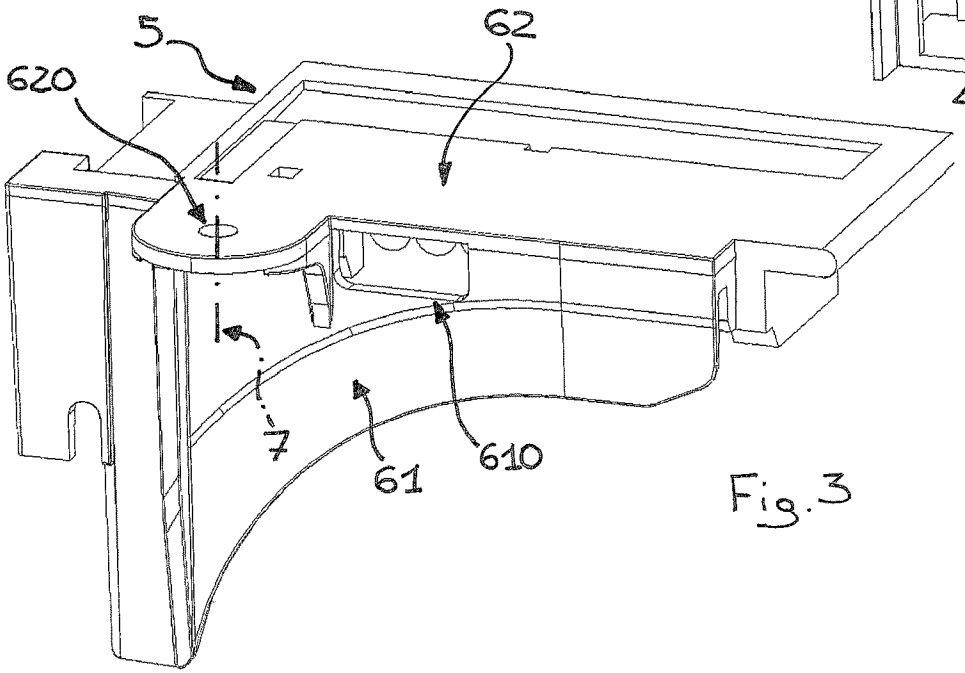
Figure 6:
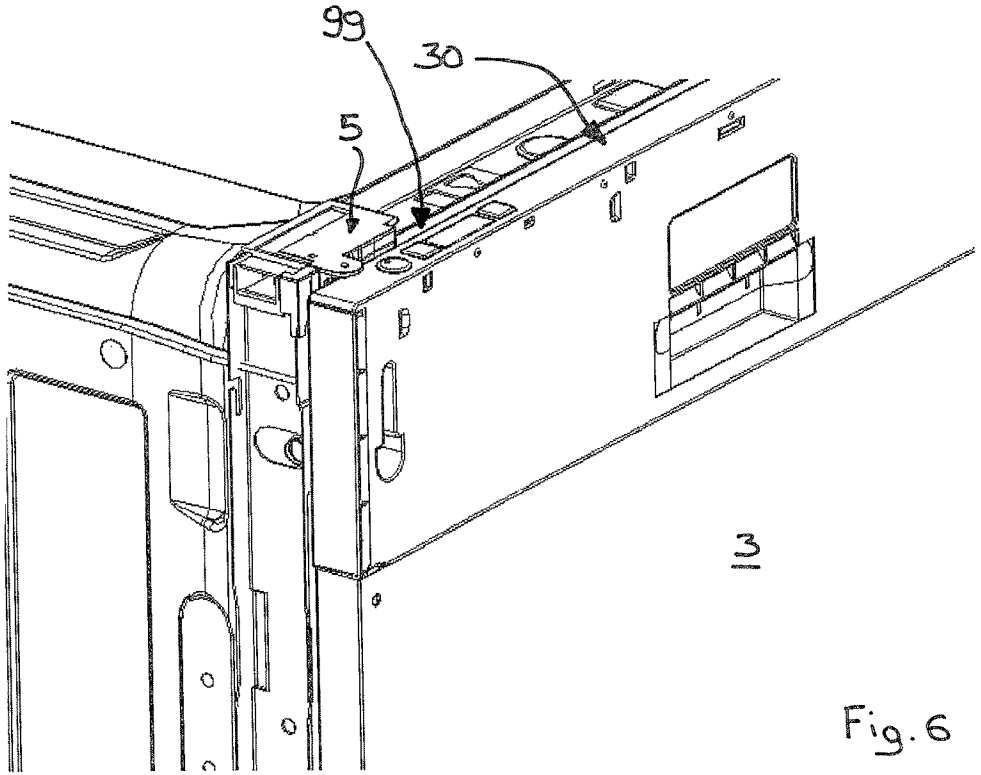
Figure 5:
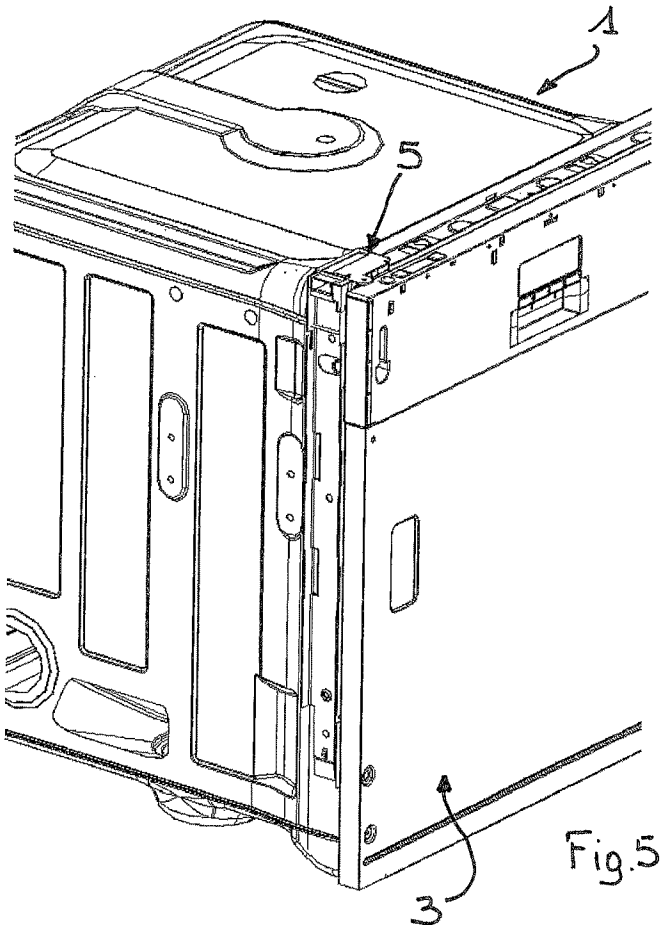

The dishwasher 1 comprises means 7 for connecting said bracket 5 and said work top and that passes through said hole 620. In FIG. 3, the connection means 7 is only illustrated schematically. It could for example comprise coach screws or another threaded means of connection.

The vertical wall 61 comprises a window 610 aligned with said lens 41 along the direction of the light beam (there is thus an overlapping of the window 610 and the lens 41 along a direction of travel of the light beam through the window 610).

Figure 8:
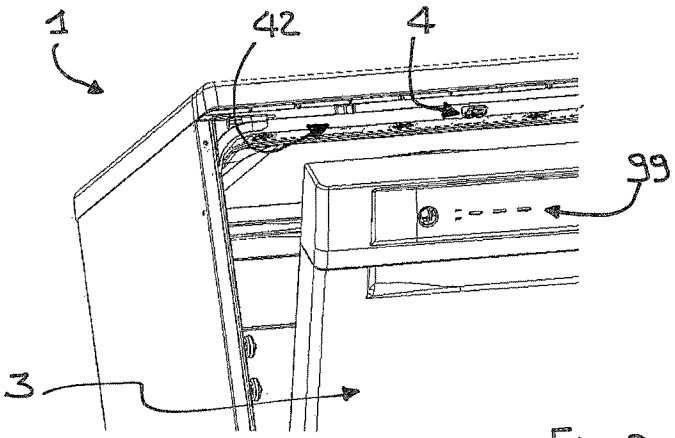
FIGS. 7 and 8 are views of a second design solution according to the present invention.
Figure 7:
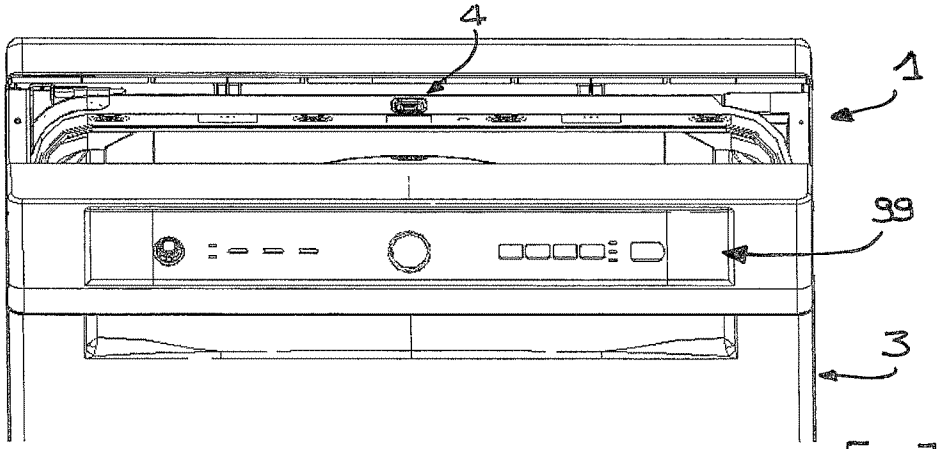

As shown in the example in FIG. 7 or 8, the dishwasher could be of the "stand-alone" type. This type of dishwasher is also known in the art as a "free-standing" dishwasher (in the accompanying figures, the user interface 99 is on the front panel). In a further design solution, the dishwasher 1 could also be of the "built in like" type (that is, a stand-alone machine, which, like the "fully integrated built-in machines", has the user interface located on the upper edge of the door 3 rather than on the front panel of the door 3).

An object of the present invention is also a method for controlling the projection means for projecting a light signal on the part of a dishwasher.

The dishwasher preferably comprises one or more of the characteristics described hereinabove. This method advantageously comprises the step of selecting one mode among the following projecting modes for projecting the light signal on a surface external to the dishwasher:

light signal not flashing during the wash and flashing at the end of the wash;

absence of the light signal during the wash and light signal flashing at the end of the wash;

absence of the light signal both during the wash and at the end of the wash.

The projection modes described above are all made available by the dishwasher.

The invention thus conceived makes it possible to achieve multiple advantages.

In particular, the invention makes it possible for the light beam to be concentrated by the lens and at the same time allows for the lens to be as concealed as possible from the sight of the user (inserting it in a narrow gap found immediately above the door in the closed position).

The invention thus conceived is susceptible to numerous modifications and variants, all of which falling within the scope of the inventive concept characterizing the invention. Moreover, all details may be replaced with other technically equivalent elements. The materials used, as well as the dimensions, may in practice be of any type, according to needs.

The invention claimed is:

1. A dishwasher, comprising:

a washing compartment for washing dishes;

a door selectively movable between an opened position, wherein the door enables access to the washing compartment, and a closed position, wherein the door is substantially vertical and closes an access opening to the washing compartment;

a frame at least partially enclosing the access opening;

a projector configured to project at least one pre-established light signal on a surface external to the dishwasher, the at least one pre-established light signal being associated with at least one of a washing state in progress or with achievement of an end-of-wash state, the projector, comprising:

a light source configured to emit a light beam; and a concentration lens located external to and above the door when the door is in the closed position, the concentration lens configured for concentrating the light beam; and a bracket for connecting the dishwasher to a work top that is located over the bracket, with the projector being supported by the bracket, the bracket comprises:

a vertical wall operably coupled to the frame, the vertical wall including a window aligned with the concentration lens along the direction of the light beam so as to permit passage thereof;

a wall extending horizontally and comprising a hole; and a fastener for connecting the bracket and the work top and that passes through the hole, wherein the light beam projected downstream of the concentration lens extends in a substantially horizontal direction.

2. The dishwasher according to claim 1 wherein the bracket is located at a junction of two edges of a perimeter of the access opening.

3. A dishwasher comprising:

a washing compartment for washing dishes;

a door that is movable between an open position and a closed position, wherein the door is substantially vertical and closes an access opening to the washing compartment;

a projector configured to project at least one pre-established light signal on a surface external to the dishwasher, the light signal being particularly associated with a washing state in progress or with an achievement of an end-of-wash state, the projector comprising:

a light source, a concentration lens for concentrating a light beam coming from the light source, the concentration lens being external to the door and solidly constrained to a frame that encloses the access opening wherein the light beam downstream of the concentration lens extends in a substantially horizontal direction; and a bracket for connecting the dishwasher to a work top that is located over the bracket, with the projector being supported by the bracket and where the bracket is an angle bracket located at a junction of two edges of a perimeter of the access opening and the bracket comprises:

a vertical wall secured to both of the two edges of the perimeter of the access opening and including a window aligned with the concentration lens along the direction of the light beam so as to permit passage thereof;

a wall extending horizontally and comprising a hole; and the dishwasher comprising a fastener for connecting the bracket and the work top and that passes through the hole.

4. The dishwasher according to claim 3, wherein the light source comprises at least one LED and a printed circuit board whereto the LED is applied, the dishwasher comprising a protective casing inside of which the printed circuit board and the LED are inserted, and the protective casing being secured to the bracket.

5. The dishwasher according to claim 4, wherein the light source comprises a plurality of LEDs, the protective casing comprising a plurality of lenses, each of which face a corresponding LED of the plurality of LEDs.

6. The dishwasher according to claim 5, wherein the protective casing is entirely made of a transparent material.

7. The dishwasher according to claim 5, wherein the concentration lens is made integrally with the protective casing.

8. The dishwasher according to claim 5, wherein the protective casing is removably connected to the bracket by elastic deformation.

9. The dishwasher according to claim 5, wherein the plurality of LEDs comprises a first LED that can emit light of a first color and a second LED that can emit light of a second color.

10. The dishwasher according to claim 9, wherein a different pre-encoded message is associated with the first color and with the second color.

11. The dishwasher according to claim 3 wherein the light source and the concentration lens are horizontally aligned and located one in front of the other.

12. The dishwasher according to claim 3 wherein the light beam, downstream of the concentration lens, intersects an imaginary vertical upwards projection of an upper edge of the door considered in the closed position.

13. A method for controlling a projector for projecting a light signal by a dishwasher, the method comprises:

selecting one mode among the following projection modes for projecting the light signal utilizing the projector of claim 3 on a surface external to the dishwater, the projection modes all being made available by the dishwasher:

light signal not flashing during a wash and flashing at the end of the wash;

absence of the light signal during the wash and light signal flashing at the end of the wash; and absence of the light signal both during the wash and at the end of the wash.

* * * * *